United States Patent [19]

Takahashi

[11] 4,277,186

[45] Jul. 7, 1981

[54] PRINTING AND DISPLAYING APPARATUS

[75] Inventor: Hiromichi Takahashi, Soka, Japan

[73] Assignee: Pentel Kabushkik Kaisha, Tokyo, Japan

[21] Appl. No.: 35,078

[22] Filed: May 1, 1979

[51] Int. Cl.[3] ..... B41J 3/04

[52] U.S. Cl. ..... 400/120; 400/25; 400/31; 400/48; 400/83; 400/903

[58] Field of Search ..... 400/23, 24, 25, 27, 400/31, 34, 44, 47, 48, 84, 85, 83, 120, 334.2, 336, 383, 568, 577, 662, 718, 718.1, 718.2, 903; 219/216; 346/76 R, 76 L, 76 PH; 428/913; 430/343

[56] References Cited

U.S. PATENT DOCUMENTS

| | | | |
|---|---|---|---|
| 1,374,056 | 4/1921 | Beeghley | 400/718 |
| 2,667,256 | 1/1954 | Madsen | 400/577 X |
| 2,913,091 | 11/1959 | Neumann | 400/334.2 |
| 3,048,253 | 8/1962 | Oldenburg et al. | 400/569 X |
| 3,161,457 | 12/1964 | Schroeder et al. | 400/120 X |
| 3,354,817 | 11/1967 | Sakurai et al. | 400/120 X |
| 3,386,551 | 6/1968 | D'Onofrio | 400/120 |
| 3,438,477 | 4/1969 | Foersterling | 400/568 X |
| 3,539,375 | 11/1970 | Baum | 430/343 |
| 3,632,969 | 1/1972 | Walkow | 400/120 X |
| 3,677,452 | 7/1972 | Wallace | 400/568 X |
| 3,710,913 | 1/1973 | Brennan et al. | 400/120 X |
| 3,795,012 | 2/1974 | Ramrath | 346/76 R |
| 3,960,072 | 6/1976 | Ahlgren et al. | 400/31 X |
| 4,024,447 | 5/1977 | Epstein | 400/120 X |

OTHER PUBLICATIONS

IBM Technical Disclosure Bulletin, "Electromechanical Variable-Index System", Klein et al., vol. 17, No. 4, Sep. 1974, pp. 959-960.

*Primary Examiner*—Ernest T. Wright, Jr.
*Attorney, Agent, or Firm*—Robert E. Burns; Emmanuel J. Lobato; Bruce L. Adams

[57] ABSTRACT

A printing and displaying apparatus for printing characters on a heat-sensitive recording medium and, at the same time, providing a visual display of printed characters to permit visual observation of the state of printing. The apparatus comprises a transparent platen having a surface area larger than the area of one frame of the recording medium which is brought into engagement at its heat-sensitive surface with the associated surface of the platen, and a thermal printing head making printing engagement with the non-heat-sensitive surface of the recording medium. The thermal printing head is carried by a carriage which is mounted on supporting means supporting the carriage so as to be movable in both the row direction and the column direction. This supporting means is controlled by drive means and drive control means so that the printing head can be moved to any desired position within the extent of one frame of the recording medium. Characters being printed on the recording medium can thus be observed through the transparent platen.

4 Claims, 6 Drawing Figures

PRINTING AND DISPLAYING APPARATUS

FIELD OF THE INVENTION

This invention relates to a printing and displaying apparatus which prints characters on a recording medium and, at the same time, provides a visual display of characters being printed to permit visual observation of the state of printing, and more particularly to an apparatus of the kind above described in which a thermal printing head is brought into printing engagement with the back or non-heat-sensitive surface of the recording medium, and a transparent platen is disposed on the front side of the recording medium to permit visual observation of the printed characters immediately after or during printing.

Known terminal output units of electronic computers include an impact type printer or a non-impact type printer and a display device such as a cathode-ray tube or a gas discharge type display panel. However, provision of both a printing device and a display device in a general-purpose computer system of simple structure results in a high system cost and requires a considerable space for installation. A printing device prints or records characters on a recording medium and has thus a displaying function in itself although it is not primarily designed for such a function. Known printers used in computer terminal units are however disadvantageous in that printed characters cannot be visually observed immediately after or during printing. The known printers are also disadvantageous in that they are not adapted to perform the displaying function of the display device such as the cathode-ray tube, since the recording medium is fed by one step upon completion of printing of characters on one row, and the characters being recorded on one frame of the recording medium cannot be directly visually observed.

DESCRIPTION OF THE PRIOR ART

With a view to obviate the difficulties pointed out above, printing and displaying apparatus having both the printing function and the displaying function demanded for the terminal units of electronic computers have been proposed hitherto. Such an apparatus is disclosed in, for example, Japanese Patent Application Laid-Open No. 52-2326. In the disclosed apparatus, a recording sheet, an inking ribbon and a special film having an adhesive resin coating are interposed between a wire-dot type printing head and a transparent platen, and characters are printed in the form of dots on the recording sheet by the printing head. The film adheres to the platen according to the printed character pattern so that the state of printing can be visually observed from the opposite side of the platen. In such an apparatus, however, a special film for visual display is additionally required, and means for erasing the pattern displayed by this special film upon completion of the display of one frame portion of the recording sheet is also required. Thus, the apparatus is considerably complex in structure and bulky in size.

Besides the impact type printer such as the wire-dot type printer above described, there is a non-impact type or thermal printer in which current is supplied to a matrix of electrical resistive elements of a thermal printing head to generate heat at selected elements thereby reducing an oxide on a recording medium or fusing a color-forming solvent on a recording medium to print desired characters on the recording medium. Such a thermal printer is described in detail in, for example, U.S. Pat. No. 3,161,457, and a thermally-sensitive recording medium suitable for the thermal printing purpose is described in detail in, for example, U.S. Pat. No. 3,539,375. The requirement for such a thermal printer is that characters can be printed on the front or heat-sensitive surface of the recording medium carrying the oxide or color-forming solvent, that is, the surface on the opposite side of the back surface which is engaged by the thermal printing head.

SUMMARY OF THE INVENTION

It is an object of the present invention to provide a novel and improved printing and displaying apparatus in which a heat-sensitive recording medium is disposed or fed with its front or heat-sensitive surface directed toward the front side of the apparatus, and a thermal printing head is brought into printing engagement with the back surface of the recording medium to print characters on the front surface of the recording medium while, at the same time, permitting visual observation of the state of printing from the front side of the apparatus.

Another object of the present invention is to provide a printing and displaying apparatus of the above character which permits selection of the operation for printing desired characters at any desired positions in the row and column directions of the recording medium as when such characters are written by a person with a pen on a sheet of paper, and the operation for moving the printing head in the row direction only and moving the recording medium in the column direction as is commonly done in a teletypewriter.

In accordance with the present invention, there is provided a printing and displaying apparatus comprising in combination a carriage carrying a thermal printing head, supporting means for supporting the carriage so as to be movable in both the row direction and the column direction, drive means for driving the carriage in both the row direction and the column direction, a transparent platen having a surface area larger than the movable range of the carriage and disposed opposite to the printing head, means for feeding a heat-sensitive recording medium between the printing head and the transparent platen, the recording medium having its heat-sensitive surface directed toward the transparent platen, and control means for controlling the drive means and the recording medium feed means to carry out printing of desired characters on the recording medium.

According to the present invention, the user can directly visually observe the state of printing on the heat-sensitive recording medium through the transparent platen due to the fact that the heat-sensitive recording medium sandwiched between the transparent platen and the thermal printing head engages at its heat-sensitive surface with the platen. Further, due to the fact that the carriage supporting mechanism is freely movable in both the row direction and the column direction, the apparatus can operate in any desired printing mode as when characters are written on a sheet of paper with a pen.

DESCRIPTION OF THE PREFERRED EMBODIMENTS

Figure 1:
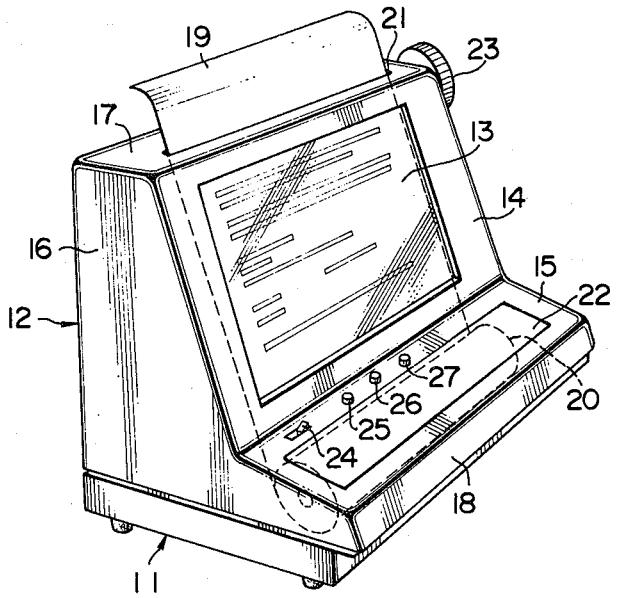
FIG. 1 is a perspective general view of a preferred embodiment of the printing and displaying apparatus according to the present invention.

FIG. 1 is a perspective general view of a preferred embodiment of the printing and displaying apparatus according to the present invention. Referring to FIG. 1, the apparatus comprises a casing 12 mounted on a base 11. The casing 12 comprises a front panel 14 having a central platen 13 of transparent material such as glass or a synthetic resin, a console panel 15 having a central opening and extending obliquely forward from the lower end of the front panel 14, a pair of side panels 16, a top panel 17, and a front skirt panel 18. A heat-sensitive recording medium 19 is shown engaging with the back face of the platen 13. This recording medium 19 is paid out from a roll 20 supported rotatably above the base 11 as shown in FIG. 1, and its leading end is drawn out to the exterior of the casing 12 from a slit 21 formed in the top panel 17. The heat-sensitive recording medium 19 employed in the present invention is well known in the art and is of the kind disclosed in, for example, U.S. Pat. No. 3,539,375 referred to hereinbefore, and detailed explanation thereof is therefore unnecessary. The heat-sensitive recording medium 19 is arranged to engage at its heat-sensitive surface with the back face of the platen 13. The front panel 14 of the casing 12 is disposed in an inclined relation as shown and is openably coupled to the body of the casing 12 by means such as hinges (not shown) so that the user can set the recording medium 19 in the apparatus and can inspect various internal parts of the apparatus by opening the front panel 14. The roll 20 of the recording medium 19 can be replaced by a new one by removing a cover member 22 openably closing the central opening of the console panel 15. A knob 23 is rotatably mounted on one of the side panels 16 of the casing 12 to be manipulated for the manual feed of the recording medium 19. Mounted on the console panel 15 are a manually actuable power switch 24, a row feed switch 25, a frame feed switch 26 and a carriage return switch 27. The row feed switch 25 functions to move a thermal printing head (described later) in the row direction only, and the frame feed switch 26 functions to feed the recording medium 19 by the length of one frame at a time. The carriage return switch 27 functions to return the printing head to its printing starting position after the printing operation on one frame of the recording medium 19.

Figure 2:
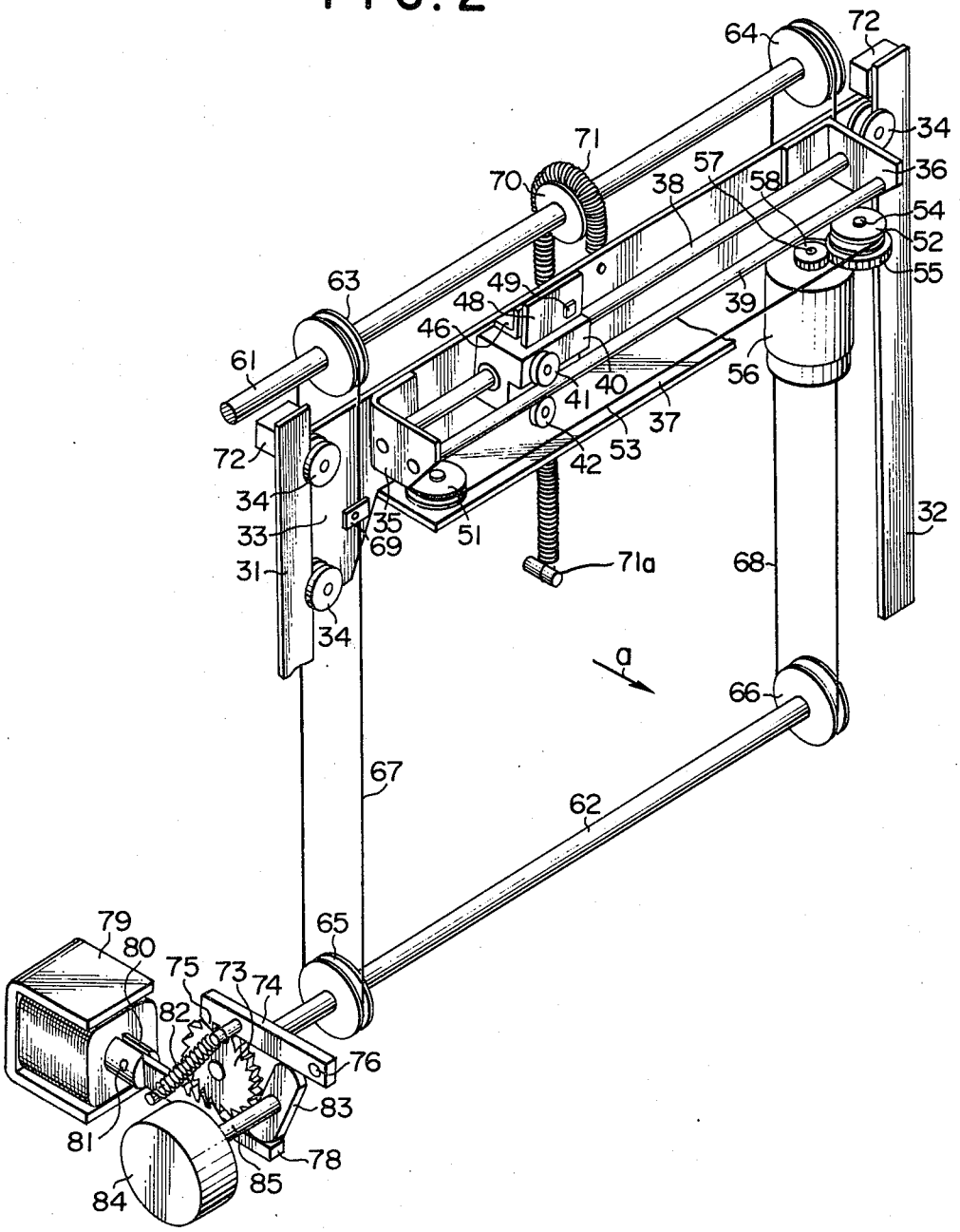
FIG. 2 is a partly cut-away perspective view of the drive mechanism in the apparatus shown in FIG. 1.
Figure 3:
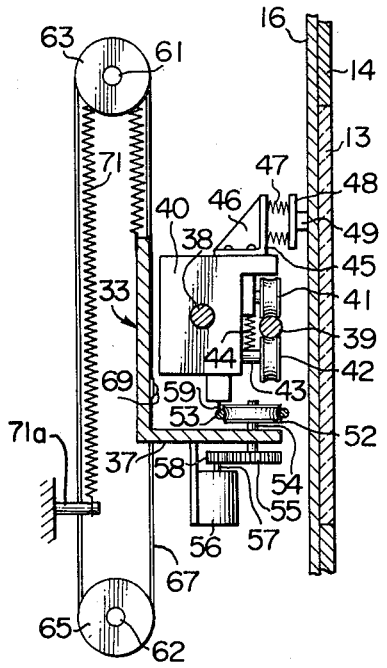
FIG. 3 is a side elevational view, depicted partly on a reduced scale, of the printing mechanism shown in FIG. 2.
Figure 4:
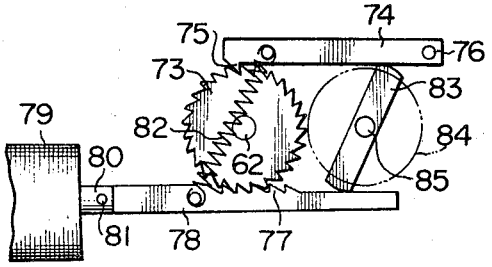
FIG. 4 is a schematic side elevational view of the ratchet wheel and associated elements shown in FIG. 2.

FIGS. 2 to 4 show a mechanism for moving the printing head in both the row direction and the column direction. Reference numerals 31 and 32 designate a pair of spaced left-hand and right-hand guide rails respectively when viewed from the front side of the apparatus. These guide rails 31 and 32 are erected upright on the base 11 and may be fixed at their lower ends to the base 11 although not shown in FIG. 2. A slider 33 in plate form extends between these guide rails 31 and 32 with its major or front face directed toward the front side of the apparatus. Guide pulleys 34 are mounted rotatably adjacent the four corners respectively of the slider 33, and the confronting edges of the guide rails 31 and 32 are received in the associated grooves of these guide pulleys 34 so that the slider 33 can make vertical movement along these guide rails 31 and 32. A pair of L-shaped angle members 35 and 36 are mounted on the opposite end portions respectively of the front face of the slider 33, and the lower end portion of the slider 33 is bent to extend substantially horizontally in the forward direction (the direction shown by the arrow a in FIG. 2) to define a flange 37 on which various parts described later are mounted.

A pair of horizontally spaced supporting rods 38 and 39 extend between the angle members 35 and 36, and a carriage 40 is slidably mounted on the supporting rod 38. A roller 41 is mounted on the front face of the carriage 40 to make rolling engagement with the upper portion of the supporting rod 39. Another roller 42 vertically spaced from the roller 41 is also mounted on the front face of the carriage 40 to make rolling engagement with the lower portion of the supporting rod 39. This second roller 42 has its shaft 43 vertically movably supported in the carriage 40, and a coil spring 44 anchored at one end thereof to the carriage 40 is anchored at the other end thereof to the roller shaft 43, as best shown in FIG. 3. Thus, the spring 44 acts to resiliently hold the supporting rod 39 between the pair of the rollers 41 and 42.

An L-shaped head supporting member 46 is mounted at one of its arms on the upper face of the carriage 40 with the other arm 45 thereof extending parallel to the transparent platen 13 as shown in FIG. 3. A head mount 48 is supported by a spring 47 on the arm 45 of the supporting member 46, and a thermal printing head chip 49 is mounted on the head mount 48 in a relation in which its printing face extends parallel to the transparent platen 13. The printing head chip 49 employed in the present invention is well known in the art and is of the kind disclosed in, for example, U.S. Pat. No. 3,161,457 referred to hereinbefore, and detailed explanation thereof is therefore unnecessary.

In FIG. 1, the platen 13 is shown inclined with respect to the horizontal, whereas, in FIGS. 2 and 3, the guide rails 31 and 32 as well as the platen 13 are shown standing upright. These elements are shown standing upright in FIGS. 2 and 3 to assist in a better understanding of the structure of the mechanism, and it is apparent that these elements are actually disposed in inclined relation as seen in FIG. 1 in which the platen 13 is inclined with respect to the horizontal.

A pair of pulleys 51 and 52 are mounted rotatably on the opposite end portions respectively of the flange 37 of the slider 33, and an endless wire 53 is trained around these pulleys 51 and 52. The shaft 54 of the pulley 52 extends downward through the flange 37 and has a gear 55 mounted on its lower end. This gear 55 is in meshing engagement with a gear 58 mounted on the output shaft 57 of a reversible stepping motor 56 fixed to the lower face of the flange 37. The endless wire 53 is clamped at a portion thereof to the lower face of the carriage 40 by a suitable clamping piece 59 so that the carriage 40 can make sliding movement along the supporting rod 38 when the motor 56 rotates in its normal and reverse directions. Of course, the endless wire 53 engages with the pulleys 51 and 52 with a high coefficient of friction so that the rotation of the stepping motor 56 can cause stepwise sliding movement of the carriage 40 with high accuracy.

The mechanism for moving the carriage 40 in the vertical or column direction comprises an upper shaft 61 and a lower shaft 62 which are spaced apart from each other in the vertical direction and extend parallel to the carriage supporting rods 38 and 39. The upper shaft 61 is fixedly supported at its opposite ends in a framework (not shown) provided on the base 11, while the lower shaft 62 is rotatably supported or journalled at its opposite ends in bearing blocks or the like (not shown) provided on the base 11 in suitably spaced-apart relation. A pair of upper pulleys 63 and 64 are rotatably mounted on the upper shaft 61 in suitably spaced-apart relation, and a pair of lower pulleys 65 and 66 are fixedly mounted on the lower shaft 62 at positions directly beneath the associated upper pulleys 63 and 64 respectively. An endless belt or wire 67 is trained around the upper pulley 63 and the associated lower pulley 65, and another endless belt or wire 68 is trained around the upper pulley 64 and the associated lower pulley 66. These endless wires 67 and 68 engage with the pulleys 63, 65 and 64, 66 respectively with a high coefficient of friction without producing any slip. The endless wires 67 and 68 are clamped at a portion thereof to the slider 33 by suitable clamping pieces 69. A pulley 70 is rotatably mounted on a middle portion of the upper shaft 61. This pulley 70 is engaged partly by a return spring 71 which is anchored at one end thereof to the slider 33 and at the other end thereof to an anchor 71*a* mounted on the framework. This return spring 71 acts to normally urge the slider 33 upward, and the upward movement of the slider 33 is limited by engagement of the upper end of the slider 33 with resilient stoppers 72 mounted respectively on the upper ends of the guide rails 31 and 32.

A ratchet wheel 73 is mounted on one or left-hand end of the lower shaft 62 and is formed with a plurality of ratchet teeth having a pitch which corresponds to each space between adjacent rows. A lever 74 for preventing reverse rotation of the ratchet wheel 73 is located above this ratchet 73. A pawl 75 is formed at one end of this reversal preventive lever 74 to disengageably engage with the successive teeth of the ratchet wheel 73 thereby preventing rotation of the wheel 73 in the reverse direction. The reversal preventive lever 74 is pivotally or swingably mounted at the other end thereof on the framework by a pivot pin 76. A rack lever 78 extends beneath the ratchet wheel 73 and has a rack 77 adapted for making meshing engagement with the teeth of the ratchet wheel 73. This rack lever 78 is pivotally or swingably connected at one end thereof to the armature 80 of a solenoid 79 by a pivot pin 81. Thus, when the solenoid 79 is energized to attract the armature 80, the cooperating rack lever 78 is also moved in that direction to cause clockwise rotation of the ratchet wheel 73. The rotation of the ratchet wheel 73 in this direction causes corresponding rotation of the lower shaft 62 whereby the endless wires 67 and 68 trained around the pulleys 63, 65 and 64, 66 respectively act to cause downward movement of the slider 33. Therefore, when the stroke of the rack lever 78 attracted due to the energization of the solenoid 79 is selected to be equivalent to the amount of angular rotation of the ratchet wheel 73 having the pitch corresponding to the distance of one row space travelled by the slider 33 in the vertical direction, the slider 33 can be moved downward stepwise from one row position to the next lower row position each time the solenoid 79 is energized. A tension spring 82 is anchored at one end thereof to the reversal preventive lever 74 and at the other end thereof to the rack lever 78 so as to insure reversal preventive engagement of the pawl 75 formed on the lever 74 with a tooth of the ratchet wheel 73 and also to insure meshing engagement of the rack 77 formed on the rack lever 78 with the teeth of the ratchet wheel 73. A return lever 83 having a length larger than the distance between the reversal preventive lever 74 and the rack lever 78 is disposed between these levers 74 and 78, and the armature 85 of a return solenoid 84 is connected to a middle portion of the return lever 83. This return solenoid 84 is of such a type that the armature 85 is rotated counter-clockwise in FIGS. 2 and 4 when the solenoid 84 is energized. Therefore, in response to the energization of the solenoid 84, the return lever 83 is rotated or turned counter-clockwise to urge the reversal preventive lever 74 upward and to urge the rack lever 78 downward in FIG. 4 thereby disengaging the pawl 75 and rack 77 from the ratchet wheel 73. Consequently, the slider 33 is urged by the return spring 71 to be moved upward toward its uppermost position at which it is engaged by the stoppers 72.

Figure 5:
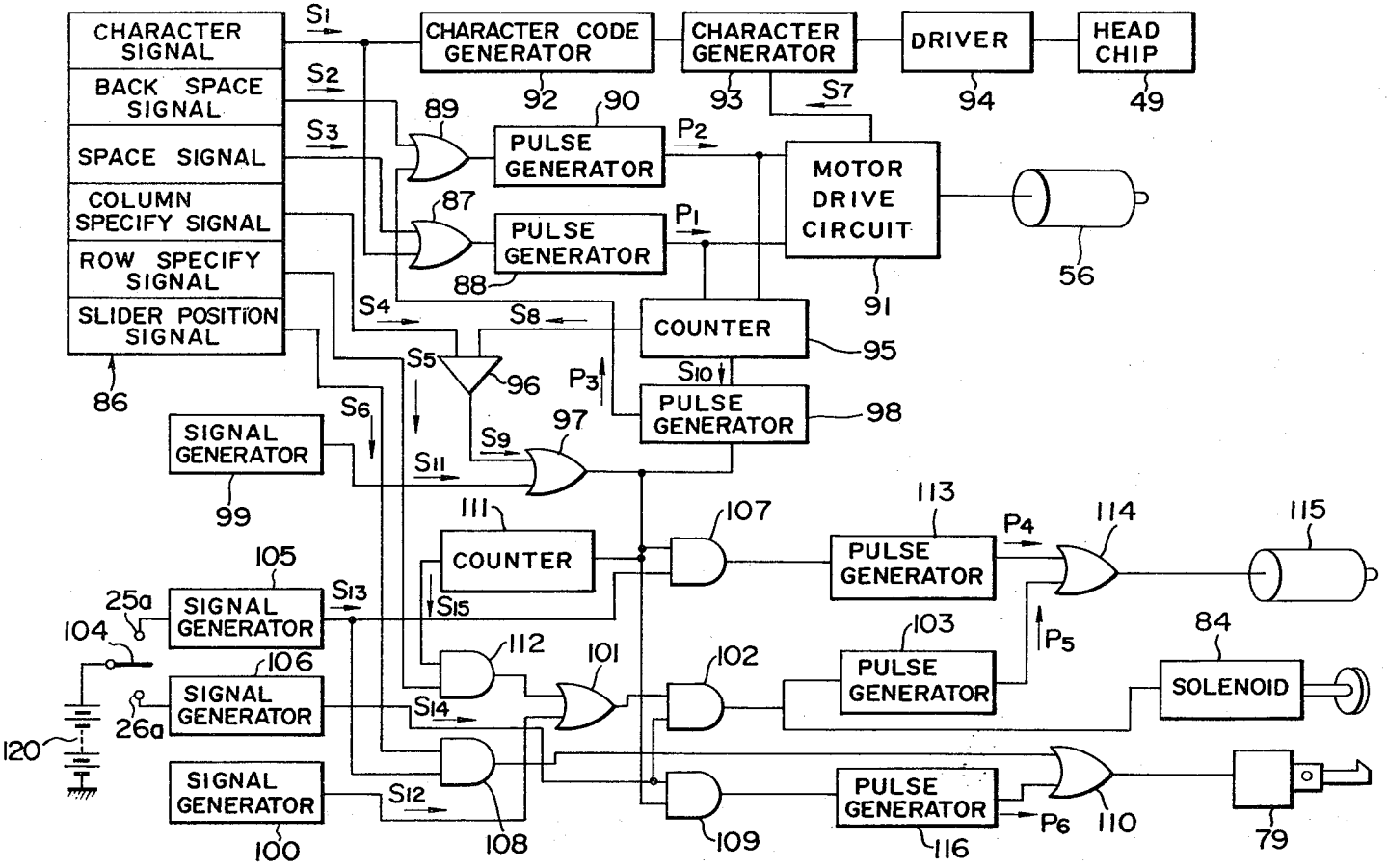
FIG. 5 is a block diagram of an electrical control circuit preferably used for the control of the apparatus shown in FIG. 1.

FIG. 5 shows a circuit for electrically controlling the operation of the mechanism above described. A keyboard 86 generates a character signal $S_1$ representing a character to be printed, a back space signal $S_2$ for back-spacing the printing head from one character printing position to another, a space signal $S_3$ instructing the space between characters or words, a column number specify signal $S_4$ specifying the number of columns in one frame, a row number specify signal $S_5$ specifying the number of rows in one frame, and a slider position signal $S_6$ instructing a desired column position for bringing the slider 33 to that position. This keyboard 86 may be disposed on the console panel 15 shown in FIG. 1 or on a separate console box when the printing and displaying apparatus is operated as an independent unit. The keyboard 86 is unnecessary when the printing and displaying apparatus is used as a terminal output unit of an electronic computer since these signals are derived from the computer.

The character signal $S_1$ and the space signal $S_3$ are applied to the individual input terminals of an OR gate 87 which is connected at its output terminal to the input terminal of a pulse generator 88 generating a pulse signal or a train of pulses $P_1$ so that the stepping motor 56 rotates by one step in its normal direction in response to the appearance of a pulse $P_1$ from the pulse generator 88. The back space signal $S_2$ is applied to one of the input terminals of an OR gate 89 which is connected at its output terminal to the input terminal of a pulse generator 90 generating a pulse signal or a train of pulses $P_2$ so that the stepping motor 56 rotates by one step in its reverse direction in response to the appearance of a pulse $P_2$ from the pulse generator 90. The output terminals of the pulse generators 88 and 90 are connected to the associated input terminals of a motor drive circuit 91. This motor drive circuit 91 is connected at one of its output terminals to the stepping motor 56 so as to rotate the stepping motor 56 stepwise in the normal or reverse direction in response to the application of the normal-rotation pulse signal $P_1$ or reverse-rotation pulse signal $P_2$.

The character signal $S_1$ is also applied to a character code generator 92 which generates a character code corresponding to the character key depressed on the keyboard 86. The character code generator 92 is connected at its output terminal to one of the input terminals of a character pattern generator 93 which is connected at its output terminal to the input terminal of a driver 94. The character generator 93 is also connected at the other input terminal to the other output terminal of the motor drive circuit 91 so that, in response to the application of a signal $S_7$ indicative of the completion of stepping rotation of the stepping motor 56 from the motor drive circuit 91, the character pattern generator 93 applies the binary-coded character pattern signal to the printing head chip 49 through the driver 94.

The output terminals of the first and second pulse generators 88 and 90 are also connected to the individual input terminals of a counter 95 which counts the number of normal-rotation pulses $P_1$ and counts down by reverse-rotation pulses $P_2$, and an output signal $S_8$ representing the count appears at one of the output terminals of the counter 95 to be applied to one of the input terminals of a comparator 96. The column number specify signal $S_4$ is applied to the other input terminal of the comparator 96. The comparator 96 generates an output signal $S_9$ when coincidence is attained between the two input signals $S_4$ and $S_8$. This signal $S_9$ is applied to one of the input terminals of an OR gate 97 which is connected at its output terminal to one of the input terminals of a pulse generator 98 which generates a train of clear pulses $P_3$ until the count of the counter 95 is counted down to zero by the reverse-rotation pulses $P_2$. After the counter 95 is cleared, the pulse generator 98 applies a pulse $P_3$ to the pulse generator 90 through one of the input terminals of the OR gate 89. The counter 95 is connected at the other output terminal to the other input terminal of the pulse generator 98 to continuously apply an output signal $S_{10}$ to this pulse generator 98, unless the count of the counter 95 is zero, thereby energizing the pulse generator 98 together with the output signal of the OR gate 97. The other input terminal of the OR gate 97 is connected to the output terminal of a signal generator 99 which generates an instruction signal $S_{11}$ instructing to restore the carriage 40, hence, the printing head chip 49 to the printing starting position in the row direction. This signal generator 99 generates such a signal $S_{11}$ when the carriage 40 has travelled to the extremity of its movement in the row direction thereby actuating a proximity switch (not shown) provided on the flange 37 or when the carriage return switch 27 shown in FIG. 1 is depressed to print characters on a new row during the printing operation in the row direction.

It is necessary to move the slider 33 upward to its uppermost position again after the slider 33 has been brought to its lowermost position. To this end, a proximity switch (not shown) is provided on the base 11 to sense the lowermost position of the slider 33, and a second signal generator 100 generates an output signal or slider end signal $S_{12}$ in response to the operation of the proximity switch. This slider end signal generator 100 is connected at its output terminal to one of the input terminals of an OR gate 101. This OR gate 101 is connected at its output terminal to one of the input terminals of an AND gate 102 whose output terminal is connected to the input terminal of a pulse generator 103 generating a train of pulses $P_5$ the number of which is equal to the number of rows that can be printed on one frame. The output terminal of the AND gate 102 is also connected to the return solenoid 84.

The row feed switch 25 and the frame feed switch 26 shown in FIG. 1 include stationary contacts **25*a* and 26*a* respectively shown in FIG. 5, and an associated movable contact 104 connected to a power source 120 is selectively brought into contact with one of these stationary contacts 25*a* and 26*a* so as to feed the recording medium 19 by the distance corresponding to one row space or the length corresponding to one frame. It will therefore be seen that these switches 25 and 26 may be combined into a single switch of seesaw type. The stationary contact 25*a* of the row feed switch 25 is connected to the input terminal of a third signal generator 105 which generates, after reshaping the waveform of the power supply voltage, an output signal $S_{13}$ having a suitable signal level for instructing feeding of the recording medium 19 by the distance corresponding to one row space. The stationary contact 26*a* of the frame feed switch 26 is connected to the input terminal of a signal generator 106 which generates, after reshaping the waveform of the power supply voltage, an output signal $S_{14}$ having a suitable signal level for instructing feeding of the recording medium 19 by the length corresponding to one frame. The row feed signal generator 105 is connected at its output terminal to one of the input terminals of an AND gate 107 and to one of the input terminals of an AND gate 108. The frame feed signal generator 106 is connected at its output terminal to the other input terminal of the AND gate 102 and to one of the input terminals of an AND gate 109. The slider position signal $S_6$ is applied to the other input terminal of the AND gate 108 whose output terminal is connected to one of the input terminals of an OR gate 110, and this OR gate 110 is connected at its output terminal to the step feed solenoid 79**.

The output terminal of the OR gate 97 is also connected to the other input terminal of the AND gate 107, to the other input terminal of the AND gate 109, and to the input terminal of a counter 111. This counter 111 counts the number of pulses included in the output signal of the OR gate 97, hence, the number of times of restoration of the carriage 40 to its printing starting position and provides an output signal $S_{15}$ representing the count. The counter 111 is connected at its output terminal to one of the input terminals of an AND gate 112 whose output terminal is connected to the other input terminal of the OR gate 101. The row number specify signal $S_5$ is applied to the other input terminal of the AND gate 112. The output terminal of the AND gate 107 is connected to the input terminal of a pulse generator 113 which generates a pulse signal or a train of pulses $P_4$ each of which is used for feeding stepwise the recording medium 19 by the distance corresponding to one row space. This pulse generator 113 is connected at its output terminal to one of the input terminals of an OR gate 114 whose output terminal is connected to a stepping motor 115 for feeding the recording medium 19 stepwise in the column direction. The other input terminal of the OR gate 114 is connected to the output terminal of the pulse generator 103. The output terminal of the AND gate 109 is connected to the input terminal of a pulse generator 116 which generates a pulse signal or a train of pulses $P_6$ each of which is used to cause stepwise downward movement of the slider 33 from one row position to the next. The output terminal of this pulse generator 116 is connected to the other input terminal of the OR gate 110 connected to the step feed solenoid 79.

The operation of the embodiment of the present invention having the aforementioned structure will now be described at first with reference to the printing mode in which characters are printed one after another on the full rows of one frame of the recording medium 19. The frame feed switch 26 is actuated to bring the movable contact 104 into contact with the stationary contact 26*a*. Consequently, the one-frame feed signal generator 106 applies its output signal $S_{14}$ to one of the input terminals of each of the AND gates 102 and 109. Then, the user manipulates a character key on the keyboard 86 to apply a character signal $S_1$ representing the selected character to the character code generator 92 and to one of the input terminals of the OR gate 87. In response to the output signal of this OR gate 87, the normal-rotation pulse generator 88 generates a pulse $P_1$ which is applied to the motor drive circuit 91 to rotate the head drive stepping motor 56 in the normal direction by one step. At the end of the stepping rotation of the stepping motor 56, the stepping completion signal $S_7$ is applied from the motor drive circuit 91 to the character pattern generator 93, and the character pattern signal corresponding to the character code supplied from the character code generator 92 is applied through the driver 94 to the printing head chip 49 to print the selected character on the recording medium 19. Such a printing cycle is sequentially repeated for each individual character. During the printing sequence, the counter 95 counts the number of normal-rotation pulses $P_1$. When the counter 95 counts the number of pulses $P_1$ equal to the predetermined number of columns specified by the column number specify signal $S_4$, the comparator 96 applies its output signal $S_9$ to the pulse generator 98 through the OR gate 97. This pulse generator 98 continues to generate clear pulses $P_3$ until the count of the counter 95 is counted down to zero by the reverse-rotation pulses $P_2$. After the counter 95 is cleared, the pulse generator 98 applies a pulse $P_3$ through the OR gate 89 to the reverse-rotation pulse generator 90. This pulse generator 90 generates a train of reverse-rotation pulses $P_2$ to apply the same to the motor drive circuit 91. Consequently, the stepping motor 56 rotates stepwise in the reverse direction until the carriage 40 returns to its original or printing starting position. The above operation completes printing of characters on one row. The space signal $S_3$ or the back space signal $S_2$ may be suitably applied when it is desired to provide a desired space between characters or words.

As described hereinbefore, the coincidence signal $S_9$ appears from the comparator 96 when the printing head chip 49 has reached the end of its travel corresponding to the specified number of columns by the stepwise normal-rotation of the stepping motor 56. This signal $S_9$ is also applied to one of the input terminals of the AND gate 109 through the OR gate 97. Due to the fact that the output signal $S_{14}$ of the one-frame feed signal generator 106 has already been applied to the other input terminal of the AND gate 109, this AND gate 109 is opened, and the pulse generator 116 applies its output pulse $P_6$ to the solenoid 79. In response to the energization of the solenoid 79, the rack lever 78 connected to the armature 80 of the solenoid 79 is attracted in FIG. 2 thereby rotating the ratchet wheel 73. The rotation of the ratchet wheel 73 causes rotation of the lower shaft 62, hence, rotation of the lower pulleys 65 and 66 mounted on the lower shaft 62, and the slider 33 fixed to the endless wires 67 and 68, hence, the printing head chip 49 is moved downward by the stroke corresponding to one row space, so that the printing head chip 49 is now ready to start printing characters on the next lower row.

Such an operation is sequentially repeated to print characters on a predetermined number of rows. When the slider 33 is moved downward to a position, for example, its lowermost position, the output signal $S_{12}$ of the slider end signal generator 100 is applied to one of the input terminals of the AND gate 102 through the OR gate 101. Due to the fact that the output signal $S_{14}$ of the one-frame feed signal generator 106 has already been applied to the other output terminal of this AND gate 102, this AND gate 102 is opened to energize the return solenoid 84. In response to the energization of this solenoid 84, the return lever 83 connected to the armature 85 of the solenoid 84 rotates counter-clockwise in FIGS. 2 and 4 to urge the reversal preventive lever 74 upward and to urge the rack lever 78 downward thereby disengaging these levers 74 and 78 from the ratchet wheel 73. Therefore, the ratchet wheel 73, hence, the lower shaft 62 can now freely rotate, and the slider 33 is urged upward to the uppermost position shown in FIG. 2 by the biasing force of the return spring 71. In the meantime, the recording-medium feed pulse generator 103 in FIG. 5 applies its output pulses $P_5$ to the recording-medium feed stepping motor 115 through the OR gate 114 thereby feeding the recording medium 19 by the length corresponding to one frame.

When it is desired to print characters on a limited number of rows which number is less than the full number of rows that can be printed on one frame, a row number specify signal $S_5$ specifying such a row number is generated from the keyboard 86. Since the counter 111 counts the number of times of restoration of the carriage 40 to its printing starting position, that is, the number of rows on which characters have been already printed, the AND gate 112 generates its output signal when the count coincides with the specified number of rows, and this output signal is applied to the AND gate 102 through the OR gate 101 so that the recording medium 19 can be fed by the length corresponding to one frame upon completion of printing, as in the aforementioned case. After the recording medium 19 has been fed by the length corresponding to one frame and the carriage 40, hence, the printing head chip 49 has been restored to its printing starting position, the next printing cycle is started in a manner as described hereinbefore.

The operation of the apparatus will then be described with reference to the continuous printing mode in which characters are continuously printed on the recording medium 19 instead of being printed on successive frames, as in the case of dumping of memory contents or preparation of tables. In this printing mode, the slider 33 is held stationary at a predetermined position, and the return solenoid 84 need not be energized. The printing function for printing characters by moving the printing head chip 49 in the row direction is the same as that described hereinbefore, and it is unnecessary to explain such a function in detail.

In response to the actuation of the row feed switch 25 to bring the movable contact 104 into contact with the stationary contact 25*a*, the output signal $S_{13}$ of the one-row feed signal generator 105 is applied together with the output signal of the OR gate 97 to the AND gate 107 to open the same, and a one-step feed pulse $P_4$ is applied from the pulse generator 113 to the recording-medium feed stepping motor 115 through the OR gate 114. Consequently, each time the printing of characters on one row is completed by the rightward movement of the printing head chip 49, the stepping motor 115 is rotated by one step, and the recording medium 19 is fed by the length corresponding to one row space. In this manner, continuous printing can be carried out. When it is desired to set the slider 33 at an intermediate position, the corresponding slider position signal $S_6$ is applied to one of the input terminals of the AND gate 108, and since the output signal $S_{13}$ of the one-row feed signal generator 105 has already been applied to the other input terminal of this AND gate 108, the gate 108 is opened to apply its output signal to the solenoid 79 through the OR gate 110. Consequently, the solenoid 79 is sequentially energized by the number of times corresponding to the desired row number to cause sequential downward movement of the slider 33 to the desired intermediate position.

During the above manner of printing operation, it may be desired to return the carriage 40, hence, the printing head chip 49 to its printing starting position from the existing position thereby printing characters on a new row, without moving the printing head chip 49 to the lowermost position or to the column position specified by the column number specify signal $S_5$. In such a case, the operation similar to that described hereinbefore can be achieved by depressing the carriage return switch 27 in FIG. 1 and applying the output signal $S_{11}$ of the carriage return signal generator 99 to the OR gate 97 in FIG. 5.

The printing head drive system in the aforementioned embodiment of the present invention is so arranged that, in response to the printing instruction signal, the printing head is moved to the instructed position for printing a character in that position and remains in that position until the next printing instruction signal is applied. However, as those skilled in the art will readily understand, the drive system may be such that the printing head is moved to the next anticipated printing position immediately after printing of a character and is ready to receive the next printing instruction signal.

Figure 6:
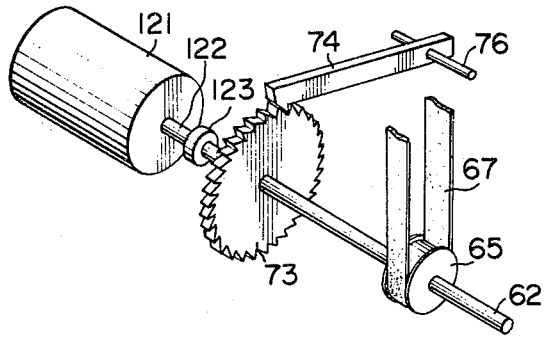
FIG. 6 is a perspective view of a modification of the arrangement shown in FIG. 4.

FIG. 6 shows a modification of the drive means for the lower shaft 62. In this modification, the solenoid 79 and the rack lever 78 in FIGS. 2 to 4 are replaced by an additional stepping motor 121, and this motor 121 is energized for driving or rotating the lower shaft 62. This stepping motor 121 is designed to rotate by one step corresponding to the downward stroke of the printing head chip 49 from one row position to the next lower row position. The lower shaft 62 is connected to the output shaft 122 of this stepping motor 121 by a coupling 123 so that it can be rotated stepwise by the stepwise rotation of the stepping motor 121. The reversal preventive lever 74 and the return solenoid 84 may be entirely the same as those shown in FIGS. 2 and 3. The arrangement may be such that this stepping motor 121 is disconnected from its power source as soon as the return solenoid 84 is energized. Then, in response to the energization of the return solenoid 84 which acts to disengage the reversal preventive lever 74 from the ratchet wheel 73, the lower shaft 62 is now freely rotatable, and the slider 33 is urged upward to its uppermost position by the biasing force of the return spring 71.

What is claimed is:

1. A printing and displaying apparatus comprising: a carriage carrying a thermal printing head; first supporting means for supporting said carriage so as to be movable in the row direction; second supporting means for supporting said first supporting means so that said carriage is movable in the column direction; a transparent platen having a surface area larger than the movable range of said carriage and disposed opposite to said printing head; feeding means for feeding a recording medium having a heat-sensitive surface between said printing head and said transparent platen such that said recording medium has its heat-sensitive surface directed toward said transparent platen; first driving means for driving said carriage in the row direction, said first driving means comprising a pair of row pulleys mounted rotatably on the opposite ends in the row direction of said first supporting means, first endless belt means trained around said row pulleys and fixed to said carriage to effect movement of said carriage in the row direction in response to movement of said first endless belt means, and a first stepping motor mounted on said first supporting means for rotatably driving one of said row pulleys to thereby effect movement of said first endless belt means; second driving means for driving said carriage in the column direction, said second driving means comprising at least one pair of column pulleys spaced apart from each other in the column direction, at least one second endless belt means trained around said column pulleys and fixed to said first supporting means to effect movement thereof in the column direction accompanied by corresponding movement of said carriage in response to movement of said second endless belt means, a second stepping motor for rotatably driving one of said column pulleys to thereby effect movement of said second endless belt means, resilient means for biasing said second supporting means toward one end position in the column direction, and ratchet means for releasably holding said second supporting means in any desired position against the biasing force of said resilient means; and control means for controlling said first and second stepping motors and said feeding means to enable printing of desired characters on said recording medium.

2. A printing and displaying apparatus according to claim 1; wherein said ratchet means comprises a rotatable toothed ratchet wheel connected to the column pulley which is driven by said second stepping motor, reversal preventive means releasably engageable with said ratchet wheel for preventing reverse rotation of said ratchet wheel, and releasing means for releasing the engagement between said reversal preventive means and said ratchet wheel to enable said second supporting means to be restored to its said one end position by the biasing force of said resilient means.

3. A printing and displaying apparatus according to claim 2; wherein said reversal preventive means comprises a pivotal reversal preventive lever pivotal into and out of engagement with said toothed ratchet wheel.

4. A printing and displaying apparatus according to claim 2; wherein said releasing means comprises a turnable lever turnable in one direction to effect disengagement of said reversal preventive means from said ratchet wheel, and solenoid means operable when energized for effecting turning of said turnable lever in said one direction.

* * * * *